United States Patent [19]

Ecker

[11] 4,307,578

[45] Dec. 29, 1981

[54] HEAT EXCHANGER EFFICIENTLY OPERABLE ALTERNATIVELY AS EVAPORATOR OR CONDENSER

[75] Inventor: Amir L. Ecker, Dallas, Tex.

[73] Assignee: Atlantic Richfield Company, Los Angeles, Calif.

[21] Appl. No.: 140,771

[22] Filed: Apr. 16, 1980

[51] Int. Cl.[3] ..... F25B 27/02; F25B 13/00; F25B 39/02

[52] U.S. Cl. ..... 62/238.6; 62/160; 62/324.4; 62/526; 165/46; 165/157

[58] Field of Search ..... 165/157, 46; 62/524, 62/525, 526, 238.6, 324.1, 624.4, 2, 160

[56] References Cited

U.S. PATENT DOCUMENTS

| | | | |
|---|---|---|---|
| 2,596,195 | 5/1952 | Arbuckle | 62/526 X |
| 2,819,592 | 1/1958 | Smith | 62/324.4 X |
| 3,345,829 | 10/1967 | Hall | 62/524 X |
| 3,435,627 | 4/1969 | Castillo | 165/46 X |
| 3,999,602 | 12/1976 | Fewell et al. | 165/157 X |
| 4,149,389 | 4/1979 | Hayes et al. | 62/160 X |
| 4,168,745 | 9/1979 | Lastinger | 62/238.6 X |
| 4,171,621 | 10/1979 | Trelease | 62/160 |
| 4,182,133 | 1/1980 | Haas et al. | 62/160 |

*Primary Examiner*—Lloyd L. King
*Attorney, Agent, or Firm*—Wofford, Fails & Zobal

[57] ABSTRACT

A heat exchanger adapted for efficient operation alternatively as evaporator or condenser and characterized by flexible outer tube having a plurality of inner conduits and check valves sealingly disposed within the outer tube and connected with respective inlet and outlet master flow conduits and configured so as to define a parallel flow path for a first fluid such as a refrigerant when flowed in one direction and to define a serpentine and series flow path for the first fluid when flowed in the opposite direction. The flexible outer tube has a heat exchange fluid, such as water, flowed therethrough by way of suitable inlet and outlet connections. The inner conduits and check valves form a package that is twistable so as to define a spiral annular flow path within the flexible outer tube for the heat exchange fluid. The inner conduits have thin walls of highly efficient heat transfer material for transferring heat between the first and second fluids. Also disclosed are specific materials and configurations.

13 Claims, 9 Drawing Figures

HEAT EXCHANGER EFFICIENTLY OPERABLE ALTERNATIVELY AS EVAPORATOR OR CONDENSER

FIELD OF THE INVENTION

This invention relates to heat exchangers; and, more particularly, to heat exchangers that are operable in either the condensing or evaporating mode with respect to a first fluid such as a refrigerant when flowed in heat exchange relationship with a second heat exchange fluid, such as a liquid.

DESCRIPTION OF THE PRIOR ART

The prior art is replete with a wide variety of heat pumps that are operable in either the heating or cooling mode. These heat pumps have been employed to pump heat from one location to another and generally employ at least two heat exchangers. These heat exchangers may employ a first heat exchanger for heating or cooling the air that is employed in heating or cooling a structure. The second heat exchanger is a heat exchanger that has employed either ambient air or a heat exchange fluid for supplying or rejecting the heat for conditioning, via a heat pump, the air in the building or the like. While it is apparent that the heat in a second heat exchange fluid, may be pumped from one location to another in conjunction with heating or cooling a first fluid for any purpose, it is in the field of air conditioning a home, building or the like that this invention is most readily understood. Accordingly, it is in this environment that this invention will be described.

As is recognized, in heat pump systems, heat is absorbed by a refrigerant by vaporizing the condensed liquid in an evaporator. In cooling, the evaporator may be employed indoors for cooling the air circulated in the building. In heating, the evaporator may be employed outdoors, or may have a heat exchange fluid that is circulated in heat exchange relationship with the refrigerant.

Many systems have been tried to employ a supplemental heat source and different approaches to the heat exchanger design where the heat exchanger was to be operated as either an evaporator or a condenser and wherein the refrigerant and a heat exchange fluid were flowed in heat exchange relationship therethrough. Typical of these are the following United States Patents. U.S. Pat. No. 2,689,090 disclosed a heating system employing a heat exchanger disposed in the soil outside the space to be air conditioned. U.S. Pat. No. 4,062,489 discloses a solar-geothermal heat system having a dual heat exchanger. U.S. Pat. No. 4,065,938 discloses air conditioning apparatus with a booster heat exchanger. U.S. Pat. No. 4,165,036 discloses an elaborate multiple-heat source air conditioning system including a convertible heat exchange means alternately operable for collection of solar heat in the first heat exchange liquid and for radiation of internal heat from a second heat exchange liquid with the media having high and low thermal masses and valve means for selective closed loop circulation through the convertible heat exchange means. U.S. Pat. No. 4,165,037 shows apparatus and method for combined solar and heat pump heating and cooling with means for combining refrigerant flow from a second and third heat exchanger coils before entering the suction side of the compressor.

Even where the prior art has employed a heat exchange fluid, such as a liquid like water or an aqueous solution of anti-freeze, the heat exchangers have ordinarily been coaxial tubes in which the outer tube was formed of steel or the like that would take the hard usage, and the high operating pressure of the refrigerant. These heat exchangers had an inner tube of thick walled copper tubing or the like that also would take the pressure surges. Ordinarily, the inner tube was formed of copper. The term copper is used as inclusive of copper alloys, such as cupronickel alloy. The inner tube had the liquid heat exchange fluid flowing through it, whereas the outer tube had the refrigerant flowing in the annular space. Attempts have been made to improve the surface area by use of spiral fins, deformed tubes or the like. The prior art heat exchangers were disadvantageous, however, in that they were expensive, could not easily be formed to a new shape and required manufacturing in a preconfiguration, requiring high cost.

Moreover, the prior art heat exchangers could only be designed for efficient operation as an evaporator or as a condenser, the heat load being significantly different in the two modes. In addition, the techniques for optimal condensation and boiling heat transfer differ, as well as the desired or allowable pressure drop for the two modes. In vapor compression systems, condensers generally have an allowable refrigerant pressure drop of 15–25 psi (pounds per square inch) whereas a good evaporator design will have a 3–6 psi pressure drop for maximum system efficiency. Ordinarily, the engineer in the prior art compromised between optimum designs for the two such that the heat exchanger did not operate efficiently in either mode.

From the foregoing, it can be seen that the prior art did not provide a completely satisfactory heat exchanger design for operating alternatively in evaporator and condenser mode. Specifically, it is desirable that the heat exchanger designed to operate efficiently as either an evaporator or a condenser have the following features.

1. The heat exchanger should be economical and minimize the requirements for having to warehouse, including stockpiling, sorting, costing and inventorying; a large number of different parts.
2. The heat exchanger should be of co-axial construction and have the refrigerant flow through the inner tubes of the heat exchanger.
3. The heat exchanger should be designed so as to afford optimum operation in either the condenser mode or the evaporator mode.
4. The heat exchanger should have the refrigerant tubing circuited in such a manner as to provide optimum heat transfer and pressure drops in either the evaporating mode or the condensing mode.
5. The outer tubing should be formed preferably of a flexible material such as a thermoplastic for the following benefits:
   a. potentially lower cost,
   b. have expansibility to resist freezing and allowing extension of the operational range without danger of leaks in the event that inadvertent freezing occurs;
   c. have expansion and contraction with pressure surges so as to flake off scale and prevent scale buildup;
   d. have a smooth, noncrystalline wall so as to minimize scale deposition;
   e. be corrosion proof so as not to require painting or degreasing;

f. be electrically nonconducting so as not to have potential for shocking an employee or user;
g. have the potential for easily cleaning the heat exchanger.

6. The heat exchanger design should be such that there is narrowing of the tube diameter in the downstream direction when the flow of refrigerant is in the condenser mode, or configuration.
7. The heat exchanger should have a small tube that will provide the effective subcooling loop for increased efficiency, compared to normal.
8. All manifolding and check valving should be disposed within the outer tube with only single respective refrigerant inlet and outlet required.
9. The heat exchanger should enable using plain, round, thin walled copper tubing for the most cost effective design and have a structure in which the thin walled tubing is not subjected to external, potentially damaging blows or the like.
10. The heat exchanger should employ sizes similar to those used for copper thin tube coils so as to reduce inventory requirements and enable significant material cost reductions due to volume buying by a manufacturer.
11. The inner tube should be able to be twisted to afford a spiral and swirling flow path for the heat exchange fluid to enhance heat transfer between it and the refrigerant fluid.

The prior art has not provided a heat exchanger having these features.

SUMMARY OF THE INVENTION

Accordingly, it is an object of this invention to provide a heat exchanger having one or more of the features delineated hereinbefore as being desirable and not heretofore provided, thereby alleviating a deficiency of the prior art.

It is another object of this invention to provide a heat exchanger than can be operated efficiently alternatively in the evaporating or condensing mode and having all of the features delineated hereinbefore as desirable and not herebefore provided.

Specifically, it is an object of this invention to provide a tube-in-tube heat exchanger design that offers optimal performance in both the evaporating mode and the condensing mode with significant savings compared to the prior art; as well as having the features delineated hereinbefore as desirable and not hereinbefore provided.

These and other objects will become apparent from the descriptive matter hereinafter, particularly when taken in conjuction with the appended drawings.

In accordance with this invention there is provided a heat exchanger adapted for efficient use as an evaporator and a condenser, respectively, for a first condensible fluid, such as a refrigerant, flowed in heat exchange relationship with a second heat exchange fluid, such as a liquid. The heat exchanger includes an outer tube, preferably a flexible tube, having sealingly connected second fluid inlet and outlet adjacent its ends for flow of the heat exchange fluid through the annular space of the outer tube. In the preferred embodiment, the outer tube is flexible so as to be bendable into a desired shape and to flex with differential pressure and temperature so as to prevent scale build up on its interior walls. The outer tube has smooth and noncrystalline interior walls so as to further minimize scale deposition. The heat exchanger includes master flow conduits for the first fluid that are sealingly connected with the flexible outer tube adjacent each end and are connected with a plurality of inner conduits that are disposed interiorly of the outer tube. The inner conduits traverse longitudinally of the flexible outer tube for at least a part of its length and sealingly connect with the master flow conduits.

Preferably, there are provided check valves so connected with the inner conduits and so disposed that the inner conduits and check valves define a parallel flow path for the first fluid when flowed in a first direction and define a serpentine and series flow path for the first fluid when flowed in the opposite direction. The inner conduits are bendable and twistable so as to be bent to a desired shape and twisted so as to define a spiral annular flow path within the outer tube for the second fluid. The inner conduits have thin walls of highly efficient heat transfer material for transferring heat between the first and second fluids. Additional details of construction of the preferred embodiments are described hereinafter under Description of Preferred Embodiments following the Brief Description of Drawings.

DESCRIPTION OF PREFERRED EMBODIMENTS

Figure 1:
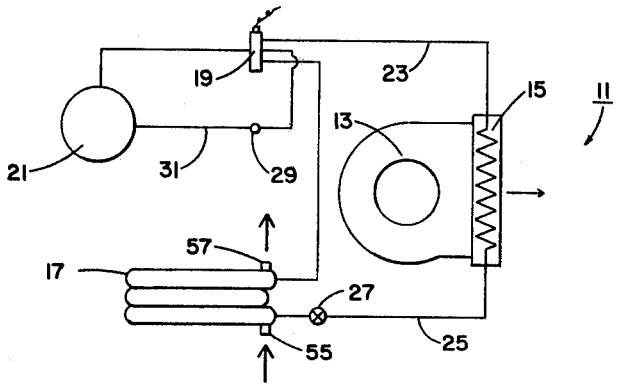
FIG. 1 is a schematic illustration of a typical heat pump installation employing one embodiment of this invention.

Referring to FIG. 1 for a clear understanding of the invention in an air conditioning system, the apparatus 11 includes an air blower 13 for circulating air past a first heat exchanger 15. The air blower may comprise any of the conventional blowers such as the so called "squirrel cage" blowers that are powered directly or by suitable intermediate links, with an electric motor or the like. These blowers and motors are designed for circulating the requisite quantity of air throughout the enclosed space to be air conditioned; for example, a building or the like. The circulation path way may comprise major ducts with tributary ducts branching off (not shown). The return to the suction side of the air blower may be by separate ducts or by way of building structure and suitable louvered inlet to the suction side of the air blower. With this technique, the air is able to be passed in heat exchange relationship with the refrigerant fluid in the first heat exchanger 15.

The first heat exchanger 15 is for refrigerant-air and is disclosed on the discharge side of the air blower so that the air is passed in heat exchange relationship with a refrigerant fluid that is passed interiorly through the coils of the first heat exchanger 15. The first heat exchanger 15 serves as an evaporator when the heat pump is being operated in the cooling mode and serves as a condenser when the heat pump is being operated in the heating mode. While the construction of the first heat exchanger 15 may take any suitable form, it is preferable to employ a conventional finned copper tube heat exchanger for efficient heat transfer regardless of whether the air is being heated or cooled.

In addition to the first heat exchanger 15, the apparatus 11 also includes a second heat exchanger 17. The second heat exchanger 17 is connected in series with the first heat exchanger 15 although the direction of flow of the refrigerant may be altered by a reversing valve 19. The second heat exchanger 17 is employed to reject heat when the apparatus 11 is operated in the cooling mode. Alternatively, it is employed to absorb heat when the apparatus is operated in the heating mode. The main thrust of this invention is directed at the second heat exchanger 17 as will become apparent from descriptive matter later hereinafter. The remainder of the schematic of FIG. 1 will be explained before the heat exchanger is detailed.

A compressor 21 is designed to compress cool, low pressure refrigerant gas to a hot, high pressure refrigerant gas that is sent to the reversing valve 19. The reversing valve then sends the hot compressed gases to the first or second heat exchanger. For example, in one position, the hot refrigerant gases are sent via conduit 23 to the first heat exchanger where the air is heated when flowed in heat exchange relationship therewith. The effluent refrigerant from the first heat exchanger then flows via conduit 25 to the second heat exchanger 17. A throttling valve 27 controls the flow of liquid, by allowing it to flash past into the second heat exchanger 17 responsive to the thermistor 29 upstream of compressor 21 and downstream of the second heat exchanger 17. Thus the refrigerant that has been liquefied in the first heat exchanger 15 is vaporized in the second heat exchanger 17 and is returned by the reversing valve via conduit 31 to the suction side of the compressor 21. This completes the cycle.

On the other hand, if the reversing valve is in another position, the hot compressed gases from the compressor 21 will be sent to the second heat exchanger 17 where they are condensed. A throttling valve, such as the throttling valve 27 controls the liquid level in the first heat exchanger 15 responsive to a thermistor 29 downstream of the first heat exchanger 15, also.

The reversing valve 19 is simply a solenoid operated valve in which a plunger directs the refrigerant to one of two paths depending upon whether it is in the cooling or heating mode. A typical reversing valve is illustrated and described in my co-pending application Ser. No. 06/125,503 filed Feb. 29, 1980 entitled "Multiple Source Heat Pump"; and the descriptive matter of that application is incorporated herein by reference for details that are omitted herefrom.

The compressor 21 may take any of the conventional forms. Preferably, it is a rotary compressor such as a rolling piston rotary compressor or a rotary vane type compressor that is designed to compress efficiently the refrigerant gas at the pressure ratio of the system.

An accumulator may be employed in the refrigerant return line upstream of the suction side of the compressor 21, if desired.

In the embodiment illustrated in FIG. 1, the second heat exchanger 17 may be employed alone or in conjunction with an outdoor, ambient air-refrigerant heat exchanger. In any event, it can be seen that the heat exchanger must operate as an evaporator and as a condenser at respective times depending upon the position of the reversing valve. As indicated hereinbefore, no heat exchanger has been available to efficiently do this job.

Figure 3:
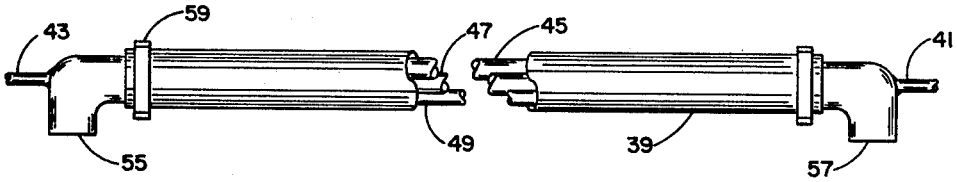
FIG. 3 is a straightened out view, with discontinuity for details, of the heat exchanger of one embodiment of this invention.
Figure 4:
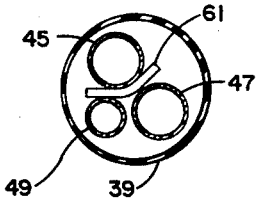
FIG. 4 is a cross sectional view of the heat exchanger of FIG. 1.
Figure 5:
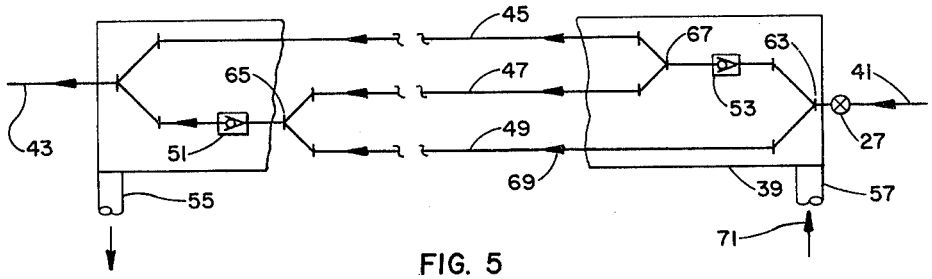
FIG. 5 is a schematic piping drawing, partly discontinuous, in accordance with a heat exchanger of this invention operating in the evaporating mode.
Figure 6:
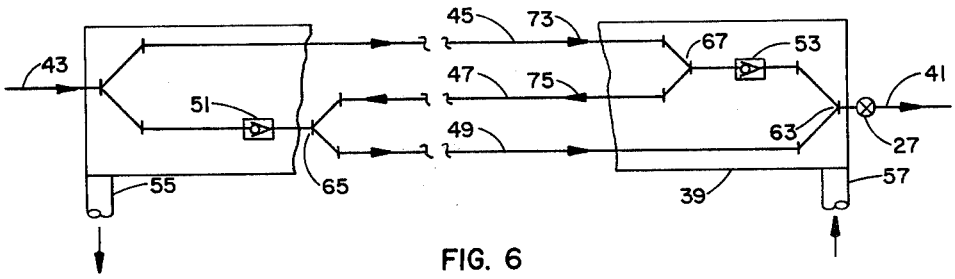
FIG. 6 is a piping schematic of a heat exchanger of this invention operating in the condensing mode.

The heat exchanger 17, FIGS. 2–7, includes a flexible outer tube 39, first and second master flow conduits 41, 43, a plurality of inner conduits 45, 47, 49 and check valves 51, 53, FIGS. 5 and 6.

Figure 7:
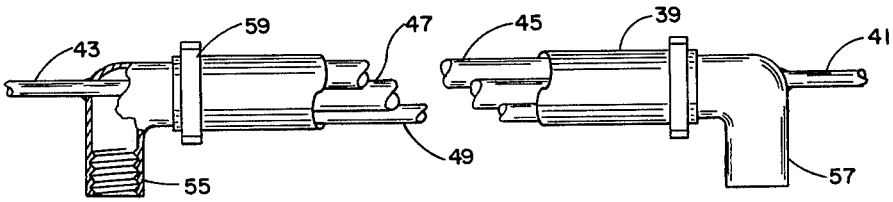
FIG. 7 is a side elevational view, partly in section, and partly discontinuous, of a heat exchanger in accordance with an embodiment of this invention.

The flexible outer tube 39 is sealingly connected with respective fluid inlet and outlets 55 and 57, FIGS. 1–7, for the heat exchange fluid. As can be seen in FIG. 7, the respective interconnections for the heat exchange fluid may comprise threaded connections for having sealingly screwed thereinto suitable bushings or other fittings for circulating the heat exchange fluid. The threaded connections may be male or female for receiving couplings, bushings, or the like for defining a circuit for the heat exchange fluid. The heat exchange fluid may be, for example, water or an aqueous solution of antifreeze such as ethylene glycol, diethylene glycol, triethylene glycol, propylene glycol and the like. As illustrated, these fluid inlet and outlets are threaded fittings though any type of connection can be employed. The fittings are formed, as by being drilled and adhered, as by brazing, silver soldering, epoxy or the like, to the master flow conduits 41, 43. The outer flexible tubing is sealingly connected at each of its ends, as by clamps 59, with the respective fittings serving as the heat exchange fluid inlet and outlet 55, 57. Of course any one of several forms could be employed. This structure is preferable, since it is only necessary to stock one premanufactured fitting that can serve as inlet and outlet ends.

Figure 2:
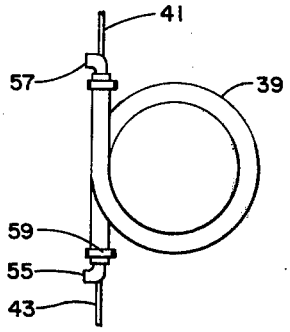
FIG. 2. is a top plan view of the heat exchanger of the embodiment of FIG. 1.

Specifically, the outer tube is flexible so as to be bendable into a desired shape. For example, as illustrated in FIGS. 1 and 2, it may be coiled into a desired coil shape for being placed in a close fitting cabinet or the like. Conversely, as shown in FIG. 3, it may be an elongate heat exchanger that can be easily disposed along a baseboard, in a corner or the like. The flexible outer tube has flexible sidewalls such that they flex with differential temperature and pressures. With this flexing, the build up of a scale on its interior walls is prevented. In addition, the flexible outer tube has smooth, noncrystalline walls that further minimize scale deposition. It has been found preferable to employ a thermoplastic material to obtain these properties. The thermoplastic materials may comprise polyethylene, polypropylene, or polybutylene, as well as the other materials normally used in making plastic hoses. If desired, it can be formed of synthetic rubber, such as Neoprene or the like.

In any event, the flexible outer tube is disposed about the plurality of inner tubes and check valves and sealingly connected with the respective end pieces 55 and 57 having inlet and outlet for the heat exchange fluid, as by way of frictional fit and clamps 59, FIG. 7.

The plurality of inner conduits 45, 47, 49 and the check valves 51 and 53 are formed into an integral unit so as to define a parallel flow path for the first fluid when flowed from the first master flow conduit 41 toward the second master flow conduit 43 and to define a serpentine and series flow path for the first fluid when flowed from the second master flow toward the first master flow conduit. The inner conduits are bendable to any desired shape. The inner conduits are twistable so as to define a spiral annular flow path within the flexible outer tube for the second fluid. The inner conduits have thin walls with highly efficient heat transfer material for transferring heat between the first and second fluids. Preferably, the thin walls are formed of a metal that transfers heat readily. Several heat transfer metals and their alloys such as aluminum, copper and even stainless steel are known. Of these, it is preferable to employ thin walled copper tubing. It is noteworth that the thin walled copper tubing is adequate since it does not have to take the external abuse and since the pressure of the refrigerant is contained interiorly of small diameter tubing with the heat exchange fluid disposed thereabout. For example, as shown in FIG. 4, the respective tubings are arranged in a bundle inside of the flexible outer tube 39.

The respective plurality of inner conduits may have the same cross sectional diameter or may have different cross sectional diameters depending upon the design desired. As illustrated, the first and second inner conduits 45, 47 have the same cross sectional diameter whereas the third conduit 49 has a different and smaller diameter. Moreover, the respective conduits may have substantially the same or different lengths depending upon the design desired as discussed hereinafter. As illustrated in FIG. 4, the respective plurality of inner conduits are mounted onto a support, such as flexible twistable ribbon 61, though this has been found to be optional. They are affixed by any conventional means such as brazing, silver soldering or the like. Alternately, small supports, made of a thermoplastic material, can be spaced on intervals to achieve the same desired effect. In this way they form a relatively stable tubing package that can be twisted without inadvertently crimping one of the tubes or otherwise interfering with the flow pattern of either of the fluids.

While the size of the conduits and tubes may vary, the following illustrates some typical sizes that can be employed with a heat exchanger for serving alternately as an evaporator and condenser for a refrigerant fluid employed in conjunction with water as the heat exchange fluid. The flexible outer tube may range in diameter from $\frac{3}{4}$ inch to as much as 2 inches or more. The first inner conduit 45 may range from nominal diameter of from $\frac{1}{4}$ inch to as much as $\frac{3}{4}$ inch. It may have a nominal wall thickness of copper tubing. This nominal wall thickness may be from 0.01 inch to as much as 0.03 inch. For example where the first tube 45 is about $\frac{3}{8}$ inch copper tubing, it will have a wall thickness of about 0.016 inch. The second inner conduit 47 may have the same cross sectional dimensions or different cross sectional dimensions as the first inner conduit 45. The same range of dimensions are applicable for the second inner conduit 47. The third conduit 49, on the other hand, is preferably somewhat smaller in the ordinary application, since it may serve as a thermal subcooling conduit in the condensing mode and have liquid flowing through it instead of gas or a mixture of gas and liquid. For example, the third inner conduit 49 may have a size of from $\frac{1}{8}$ inch to as much as $\frac{1}{2}$ inch cross sectional diameter with the nominal wall thicknesses of copper tubing, if copper tubing is employed. For heat pumps of capacity greater than 10 tons, the foregoing dimensions would be suitably enlarged.

The plurality of flexible inner conduits and check valves are connected into an assembly and connected with the respective master flow conduits 41 and 43.

A first master flow conduit 41 is connected with an expansion valve 27 for controlling the flow of liquid therethrough. As indicated hereinbefore, a thermistor 29 at the discharge side of the heat exchanger, FIGS. 1 and 5 may be employed to control operation of the thermal electric expansion valve 27 for controlling the flow of liquid through the heat exchanger, though any of the more conventional refrigerant metering devices can be utilized. At the other end, the second master flow conduit 43 is similar to the first master flow conduit 41. As illustrated, they are formed of copper tubing ranging in cross sectional diameter from $\frac{3}{8}$ to $\frac{7}{8}$ inch in diameter. For example, they may be formed of $\frac{3}{8}$ inch copper tubing to facilitate joinder with the remainder of the fittings and inner conduits. As illustrated in FIG. 5, the respective first master inlet 41 is connected by way fitting 63 to the smaller third inner conduit 49. The fittings herein may be tees, ells, Y's or the like. The third inner conduit 49 is connected intermediate the second check valve 51 and the second inner conduit 47 via fitting 65. Check valve 53 is then connected intermediate the first fitting 63 and a Y-fitting 67. The bifurcated ends of the Y-fitting 67 are connected, respectively, with the first inner conduit 45 and the second inner conduit 47. The second ends of the first conduit 45 and the second conduit 47 are connected respectively on the opposite sides of the check valve 51 for effecting serpentine flow in one of the modes of operation and parallel flow in the other mode.

Of course, as indicated hereinbefore more tubes and check valves can be connected to effect as many serpentine passes or parallel tributaries of flow as desired. Interconnections of the copper tubing are made by any of the suitable conventional techniques, such as thermally adhering the respective ends of the fittings and tubing together in such a manner as to hold the refrigerant interiorly of the conduits and the heat exchange fluid exteriorly thereof.

In operation, the heat exchanger is connected into the system as desired with the respective heat exchange fluid circuits and refrigerant fluid circuits. Typically a heat exchange fluid circuit will comprise a surge tank with a pump means for circulating the heat exchange fluid through the second heat exchanger 17. If it is desired, a second pump and heating means may be employed for either: (1) heating the fluid in the surge tank, as by circulating through a solar collector; or (2) cooling the heat exchange fluid, as by circulating through a cooling means like a natural spring.

If the second heat exchanger 17 is to be employed in the evaporating mode, or as an evaporator, after it is connected in the desired manner, with or without the twist of the tube bundle, the refrigerant is flowed through the first master inlet conduit 41 past the expansion valve 27. The liquid refrigerant has a small mass flow flowing through the third inner conduit 49 but the bulk of the mass flow is divided to flow through the first and second conduits 45 and 47. Accordingly, as indicated by the arrows 69, the flow of the refrigerant is in parallel through the respective three interconduits and interiorly of the heat exchange fluid flowing in the annular space within the outer flexible tube 39. If concurrent flow is desired, the heat exchange fluid will flow in through the inlet 57, as shown by the arrow 71 and flow outwardly through the outlet 55. A refrigerant flow is then combined to flow outwardly through the second master flow conduit 43. In this way there are three flow paths so there is very little pressure drop since the evaporating liquid is accomodated by the three respective conduits.

On the other hand, when the second heat exchanger 17 is operated in a condensing mode, the hot gaseous refrigerant is circulated in heat exchange relationship with a cool or cold heat exchange fluid. The hot refrigerant gas comes in through the second master flow conduit 43 and encounters check valve 51, FIG. 6, forcing it to flow through the first inner conduit 45. When it reaches the end it encounters the check valve 53 and is forced to flow in serpentine fashion, as shown by the arrows 73, 75, back through the second inner conduit 47. Similarly, it encounters the other side of the check valve 51 at a lower pressure than the incoming refrigerant so flows into the third inner conduit 49. Desirably, adequate condensation may be effected through the first and second conduits 45 and 47 with the inner conduit 49 serving primarily as a liquid flow path and also acting as a subcooling circuit for subcooling the liquid refrigerant by the cool heat exchange fluid. The liquid then flows into the first master flow conduit 41 flowing backward through an open bi-directional throttle valve 27.

EXAMPLE

In this example, Applicant designed a second heat exchanger to employ ⅜ inch outside diameter (OD) first and second copper inner conduits having 0.016 wall thickness with the third inner conduit 49 being ¼ inch OD copper tubing with nominal wall thickness, all inside a one inch polybutylene tube and end pieces as illustrated. The initial heat exchanger was designed to be 25 feet in length. It was built as illustrated in FIGS. 5 and 6; and was tested in a research environment monitoring flow rates, heating and cooling loads and power consumption.

The performance of this heat exchanger exceeded design specifications so it was decreased to only 20 feet in length. It still performed satisfactorily and was superior in performance to a conventional heat exchanger that cost more than four hundred percent more.

Figure 8:
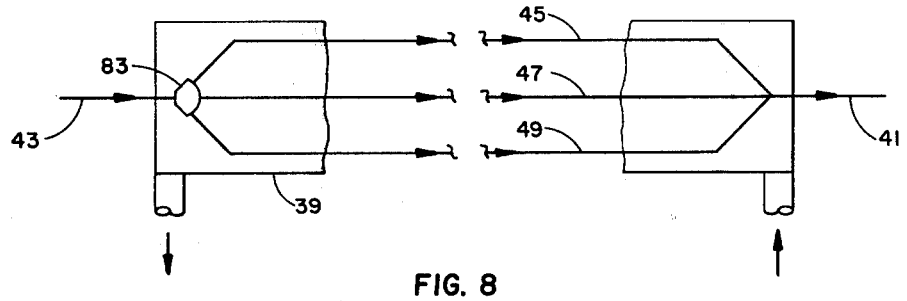
FIG. 8 is a schematic piping drawing showing another embodiment of this invention operating in parallel flow.
Figure 9:
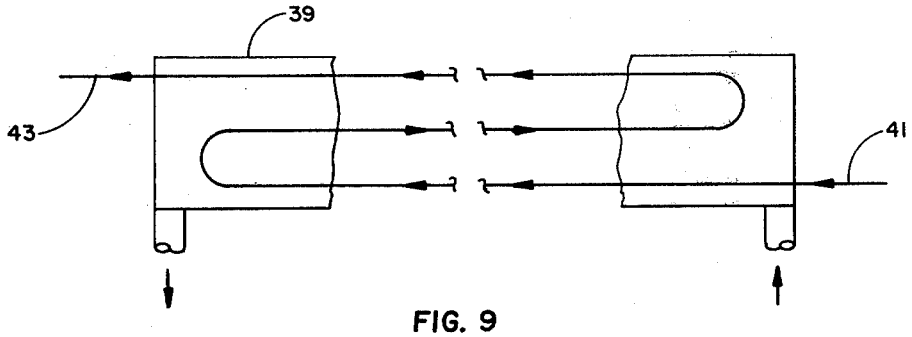
FIG. 9 is a schematic piping drawings of still another embodiment of this invention operating in series flow.

Referring to FIGS. 8 and 9, there are illustrated two other respective embodiments of this invention. In FIG. 8, the master flow conduit 43 is connected with a flow divider, or distributor, 83. The three inner conduits 45, 47, 49 are connected to the effluent end of the flow divider and are the same size in order to get equal flow through the respective conduits. In FIG. 9, the respective inner conduits 45, 47, 49 are serially connected together to form a series, or serpentine, flow path that is connected at each end with the master flow conduits 41, 43.

Otherwise, the same construction and operational flexibilities and advantages are applicable to the embodiments of FIGS. 8 and 9. Specifically, the outer conduit is preferably flexible, as by being formed of polybutylene; the inner conduits are thin walled for excellent heat transfer and twistable; the entire assembly being able to be coiled to fit small spaces. The heat transfer fluid flows through the annular space and the refrigerant, or analogous fluid, flow through the inner conduits.

This invention incorporates, in the various embodiments, the features delineated hereinbefore that are desirable but not heretofore provided. In specific embodiments, it incorporates all of the features delinated hereinbefore.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter being had to the appended claims.

I claim:

1. A heat exchanger adapted for efficient use alternatively as an evaporator or as a condenser with a first condensable fluid, such as a refrigerant, flowed in heat exchange relationship with a second heat exchange fluid, such as a liquid, comprising:

a. an outer tube having sealingly connected inlet and outlet for said second fluid adjacent its ends for flow of said heat exchange fluid through the annular space of said outer tube; said outer tube being bendable into a desired shape;

b. first and second master flow conduits for said first fluid, sealingly connected with said outer tube adjacent each respective end thereof;

c. said first master flow conduit that will serve as inlet for said first fluid when said heat exchanger is operated as an evaporator being adapted for connection with an expansion valve means for controllably flashing said first fluid into said first master flow conduit;

d. a plurality of inner conduits and check valves with at least the conduits being disposed interiorly of said outer tube; said inner conduits traversing longitudinally of said outer tube and sealingly connected with respective said pair of master flow conduits; said inner conduits and check valves defining a parallel flow path for said first fluid when flowed from said first master flow conduit toward said second master flow conduit and defining a serpentine and series flow path for said first fluid when flowed from said second master flow conduit toward said first master flow conduit; said inner conduits being bendable to said desired shape and being twistable so as to define a spiral annular flow path within said outer tube for said second fluid when desired; said inner conduits having thin walls of highly efficient heat transferring material for transferring heat between said first and second fluid; such that said heat exchanger and said respective inner conduits size and configuration can be designed for optimum service at both evaporator and condenser conditions at respective times and loads and for respective directions of flow of at least said first fluid.

2. The heat exchanger of claim 1 wherein said outer tube is flexible so as to be bendable into a desired shape and to flex with differential pressures and temperatures of flow of said second heat exchange fluid so as to prevent scale build-up on its interior walls and having smooth, noncrystalline interior walls to further minimize scale deposition as well as to minimize fluid pressure drop.

3. The heat exchanger of claim 1 wherein said outer tube is thermoplastic.